United States Patent [19]

Jolly

[11] 4,122,983

[45] Oct. 31, 1978

[54] VERSATILE DISPENSING DENTAL HYGIENE AND SHAVING DEVICE

[76] Inventor: James D. Jolly, Rte. 2, Glen Dean, Ky. 40141

[21] Appl. No.: 729,116

[22] Filed: Oct. 4, 1976

[51] Int. Cl.[2] ..... G01F 11/00

[52] U.S. Cl. ..... 222/390

[58] Field of Search ..... 222/390; 401/175; 251/347; 92/203, 207

[56] References Cited

U.S. PATENT DOCUMENTS

| | | | |
|---|---|---|---|
| 1,336,390 | 4/1920 | Sargery et al. | 401/175 |
| 1,340,043 | 5/1920 | Grace | 222/390 |
| 1,374,294 | 4/1921 | Fisher et al. | 401/175 |
| 1,498,439 | 6/1924 | Flor | 222/390 |
| 1,944,067 | 1/1934 | Collins | 401/175 |
| 2,107,242 | 2/1938 | Gates | 222/390 X |
| 2,284,533 | 5/1942 | Neuman | 222/390 X |
| 2,666,940 | 1/1954 | Davison | 401/175 |
| 2,699,889 | 1/1955 | Johnson | 222/390 |
| 2,774,981 | 12/1956 | Bonilla | 401/175 |
| 2,895,773 | 7/1959 | McConnaughey | 92/207 X |
| 3,527,441 | 9/1970 | Fisher | 251/347 |
| 3,993,226 | 11/1976 | Parenick | 222/390 X |

*Primary Examiner*—Joseph F. Peters, Jr.
*Assistant Examiner*—Norman L. Stack, Jr.
*Attorney, Agent, or Firm*—John E. Benoit

[57] ABSTRACT

A portable dispensing device which includes a head assembly having an orifice therein and a handle assembly removably attached to said head assembly. The handle assembly includes a hollow substantially rigid reservoir housing having a piston assembly axially mounted therein and a means at the end of the housing opposite the head assembly for sealing the housing. A tapered expandable sleeve having a compensating expander therein, cooperating with a mating element within said sleeve and on the exterior of the expander for preventing rotational movement between the sleeve and the expander. A piston compressing adjusting disk is provided for axially moving the expander within said sleeve, and internal threading within said expander mates with an externally threaded feed rod which extends substantially the length of said housing and is secured to an actuating knob external of said housing.

8 Claims, 19 Drawing Figures

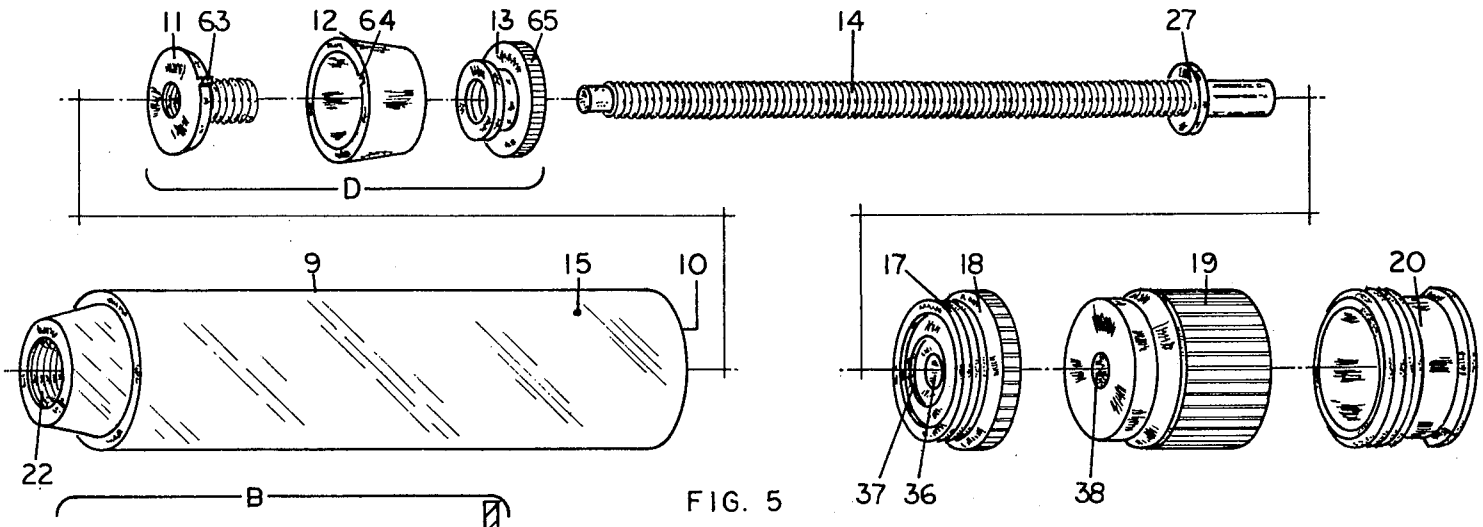
FIG. 5
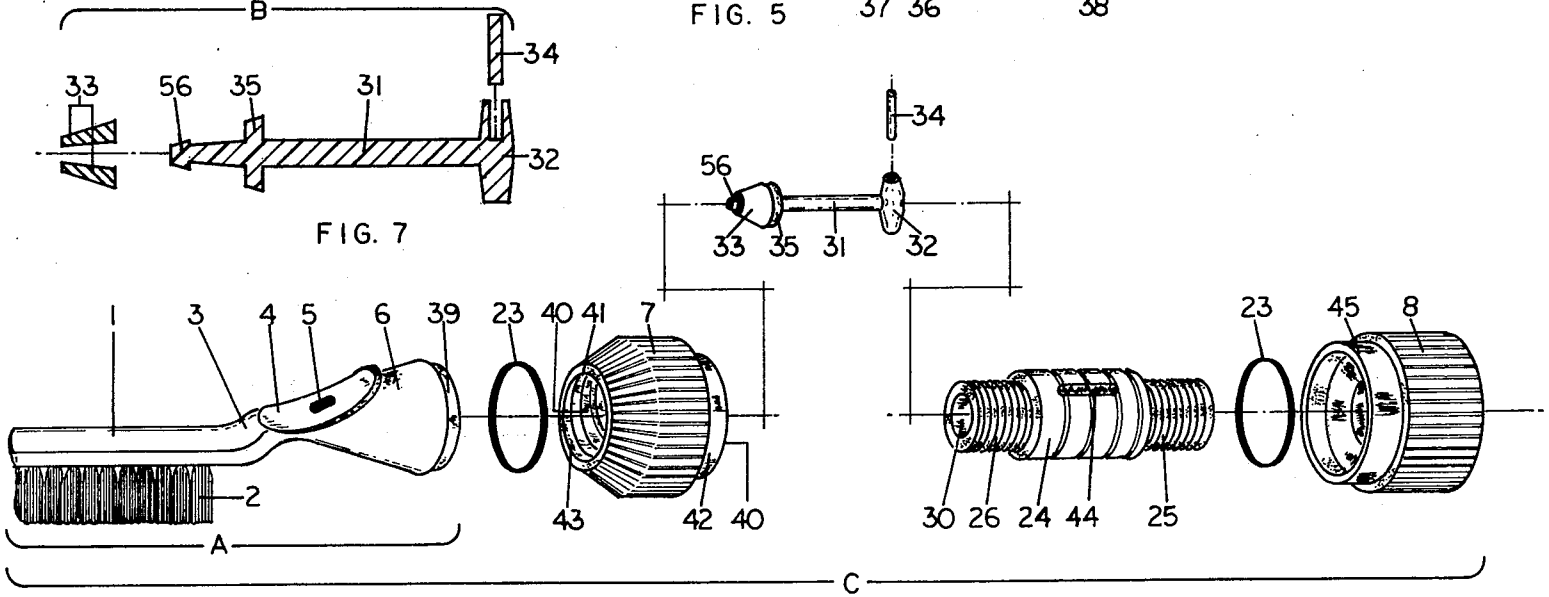
FIG. 6
FIG. 7

VERSATILE DISPENSING DENTAL HYGIENE AND SHAVING DEVICE

SUMMARY OF THE INVENTION

This invention primarily fulfills the needs of people practicing dental hygiene to facilitate this practice regardless of the type of teeth the practitioner may have, natural teeth, partially false, or totally false, currently or at some future time.

More particularly, the invention is singular dental hygiene and shaving device to be used by people who are away temporarily from permanent residence, such as, salesmen, business executives, atheletes, entertainers, actors, hospital patients, truck drivers, bus drivers, railroad personnel, airline personnel, campers, tourists, vacationers, armed forces services personnel, etc., and also by others who desire to practice dental hygiene or to shave at their place of employment as well as at their residence.

Prior art devices, due to their many limitations and deficiencies, do not have a practical and commercial value and are mostly figments of the imagination rather than workable devices. For example, many dispensing devices have such a small bore or conduit (approximately 1/32 inch) through which contents are supposed to flow that it is very doubtful if any contents are dispensed at all at its discharge point. Many prior devices also have dispensing passages or conduits, not in a straight line to promote a steady and smooth discharge but through cavities, other conduits, or angular passages, some at 90°, which definitely would retard and restain the flow of contents. Many inventors of prior art devices purport that powdered material also can be dispensed; by their system design and construction it is impossible for this action to take place as this powder definitely would be too compacted to be discharged under pressure.

Most, if not all prior devices, are highly unsanitary and untidy due to system design and construction wherein there always will be some content, dentifrice, for example, in the dispensing spout or conduit or in the brush-head plus additional dentifrice that would "ooze out" at the discharge point thereby exposing this wasteful overflow dentifrice to air causing bacterial growth; no provision has been made to assure a positive closure means to stop the flow of dentifrice at its extreme discharge point. A flapper valve will not provide a positive closure. In addition, most, if not all known devices, do not have easy access means to vary or regulate the amounts of dispensing dentifrice at its discharge point.

Also, most, if not all prior art devices, by system design and construction and, in particular, by required location of the brush-head, certainly would bruise the mount and/or cheek during the process of brushing natural teeth. This prime disadvantage would prove ineffectual as far as commercial merit or value is concerned.

In addition, most prior art devices use a specially-manufactured tube or cartridge of dentifrice that must be inserted in the dentifrice chamber or reservior of the handle portion of the device to function properly. This requirement is definitely a nuisance feature by restricting the user to purchasing only this one type of dentifrice container. There is no doubt that the purchase price of such a container of dentifrice would be substantially higher than the conventional mass-produced tube of dentifrice currently available on the market.

Furthermore, all known prior art devices, by system design and construction, restrict the user from purchasing any size, brand, or type of dentifrice commonly available on the market; there is no freedom of choice on the part of the user who is required ot either purchase one size, one type, or one brand of dentifrice.

Prior art dispensing devices empolying means of a simple piston to force dentifrice outwardly from the device encounter disadvantages in ordinary and anticipated waer and tear and subsequent and rapid loss of compressive strength in the piston itself; this piston would soon wear out along its perimeter whereby no dispensing of contents takes place. This results in the escape of dentifrice from in front of the piston, over and around the perimeter of the piston, and finally resting in back of the piston where it was not intended to be. The "wearing down" process of the piston also would result in malfunction of the device by the spinning of the piston within the dentifrice container. In other words, no provision has been made to compensate for this loss of compression without resorting to purchasing a replacement part.

Most, if not all prior art devices employing means of a simple piston to force dentifrice outwardly from the device presents an awkward and complex maneuver for the user when refilling the reservoir with a new specially-manufactured tube or cartridge. In such a situation, the entire piston assembly consisting of a piston head, feed screw rod, and externally-located feed actuating disk plus an end cap must all be removed from the device to insert the new container. After the new container has been inserted into the handle of the device, the reverse procedure of the above is performed plus the disadvantage of the feed screw rod first must be poked through the center of the entire cartridge of dentifrice before final reassembly takes place.

Many prior art devices have such a complex arrangement of parts to affect the discharge of dentifrice that said devices would be prohibitively expensive to manufacture.

The majority of known prior art devices dispense dentrifice within the tooth brush-head or onto the bristles of the tooth brush wherein numerous functioning problems during the brushing of teeth or the cleaning of the tooth brush itself can be encountered thereby making such devices ineffectual.

Some prior art devices have means for conversion to a shaving device; by system design and construction these devices can not function properly.

No known prior art device discloses means to determine quickly the amount of contents remaining in the dispensing device.

No known prior art device discloses means to determine quickly the amount of contents remaining in the dispensing device.

Known prior art devices are limited expressly to dental hygiene practitioners who have natural teeth. In turn, no known such device can function properly by those practitioners with partially false or totally false dentures.

Consequently, due to the disadvantages, deficiencies, and limitations of known prior art dental hygiene devices, it shall become apparent to those skilled in the art not only the superiority of the present invention by alleviating the aforementioned problems but also in its commercial "eye-appeal", practicality, ease of mass production, and multi-purpose denture usage—all contributing to a useful device for all people.

Accordingly, it is a primary object of the invention to provide a commercial product, namely, a multi-purpose dispensing dental hygiene device, for all practitioners of good dental hygiene practices regardless of a person's dentures.

Another object of the invention is to provide a most sanitary, non-clogging personal dental hygiene device with a positive closure at its extreme discharge point.

The object of the invention also is to enable the user to check instantly, by visual means, the amount of dentifrice, cleansing agents, dental adhesive agents or other materials remaining in the device.

Another object of the invention is to enable the user to vary the above-named amounts to be dispensed.

A further object of the invention is to provide a dispensing passage-way sufficiently large enough to allow reservoir contents of the device to be dispensed easily without restriction.

Still a further object of the invention is to provide means, by use of available adaptors, for the user to purchase any size, any brand and any type of dentifrice agent, denture cleansing agent, denture adhesive agent or shave cream agent to be used with the device.

Another object of the invention is to provide a dispensing device which can be easily cleaned and sanitized when switching materials to be dispensed from one type to another.

Still another object of the invention is to provide a dispensing device having not just a piston or some other compressing agent but an adjustable piston assembly to assure sufficient compression within a reservoir to dispense the contents thereof effectively.

A further object of the invention is to provide a vent in the reservoir to permit trapped air within the reservoir to escape resulting in easy filling of contents into reservoir whenever necessary.

Another object of my invention is to provide means to prevent component parts of the device from slipping or turning unintentionally.

Still another object of the invention is to provide an effective leakproof arrangement of parts.

A further object of the invention is to provide practitioners with false dentures means of brushing dentures to remove food particles plus means of using denture cleansing tablets to remove film and stain from same.

Another object of the invention is to provide means to insert, visually check supply, dispense, retain and store easily denture cleansing tablets.

Still another object of the invention is to provide means whereby a practitioner with false dentures can store and dispense denture cleansing tablets in one reservoir, store and dispense denture adhesive cream, in another, and brush dentures all in one portable device.

A further object of the invention is to provide the user with easy and inexpensive means to attach a toothbrush head from various available sizes and types, denture bristles, or to attach a shaving head.

A further object of the invention is to provide a sanitary protective snap-on cap easily inserted over the tooth-brush head or shaving head portion of the device.

Another object of the invention is to provide the storing and dispensing of a few denture cleansing tablets by an internal stopper which instead of tablets may enclose a bobbin of dental floss.

Still another object of the device is to employ effective means to absorb thrust parallel to the rotation of a threaded spiral feed rod.

A further object is to provide effective means to stop the longitudinal advancement of the valve seat.

Yet another object is to provide means whereby piston actuating knob need not always be rotated to express contents.

Another object is to provide effective means whereby head and barrel assemblies are easily attached or detached.

Still a further object is to provide effective and functional means for opening and closing the dispensing saddle orifice.

An object also is to provide means for the longitudinal advancement and regression of the valve stem assembly.

A further object is to provide a removably attached valve seat for means of easy replacement when required.

Yet another object is to provide effective means of retaining the valve seat in position on the valve stem.

Another object is to provide sanitary and convenient means whereby paste, cream, lather, and liquid can be dispensed through a member exteriorally mounted on the surface of the device.

Still another object is to provide means of reducing friction and of lubricating the interior of the rotatable knurled regulating ferrule.

Still another object is to provide means whereby the knurled regulating ferrule is held in place in one location without it being secured.

Still another object is to provide means whereby the adaptor being attached to an unexpended external content container can be sealed.

A further object is to prevent breakage of and to compress, for discharge, denture cleansing tablets.

A still further object is to provide means to seal dispensing end of tablet dispensing tube to keep contents therein sanitary and dry.

Another object is to provide means to attach tablet dispensing tube within barrel of the device to provide easy insertion of denture cleansing tablets therein.

Still another object is to provide effective and functional means to hold, store, visually check supply, and disengage powdery materials.

Yet another object is to provide means for sealing tapered or front end aperture of barrel with powdery material therein.

A further object is to provide effective means to seal large rear end aperture of barrel with powdery material therein.

Still a further object is to provide effective and functional means of regulating and dispensing powdery material in large or small amounts.

An object is to provide means to close and stop the dispensing action of powdery material.

Still another object is to provide effective and functional means for holding, storing, and dispensing denture cleaning powder, denture adhesive cream or paste, and having a denture brush all in one portable device.

Yet another object is to provide easy rotatability of secured rotating disk in the dispensing of powdery materials.

Still another object is to provide means to attach easily one barrel to another in tandem.

A still further object is to provide means to fill, hold, check visually contents therein easily and quickly, and dispense, independently, two different materials in tandem without disrupting the specific functions of either one.

A better understanding of the means in which the subject invention achieves the objects of my invention will become apparent when the written description is considered in conjunction with the appended drawings and claims.

BRIEF DESCRIPTION OF THE DRAWINGS

FIG. 5 is an exploded view of the handle assembly of the preferred embodiment.

FIG. 6 is an exploded perspective view of the head assembly with the tooth-brush dispensing housing as one of the attachments.

FIG. 7 is an enlarged exploded cross-sectional view of the valve assembly.

DESCRIPTION OF THE PREFERRED EMBODIMENT

Figure 1:
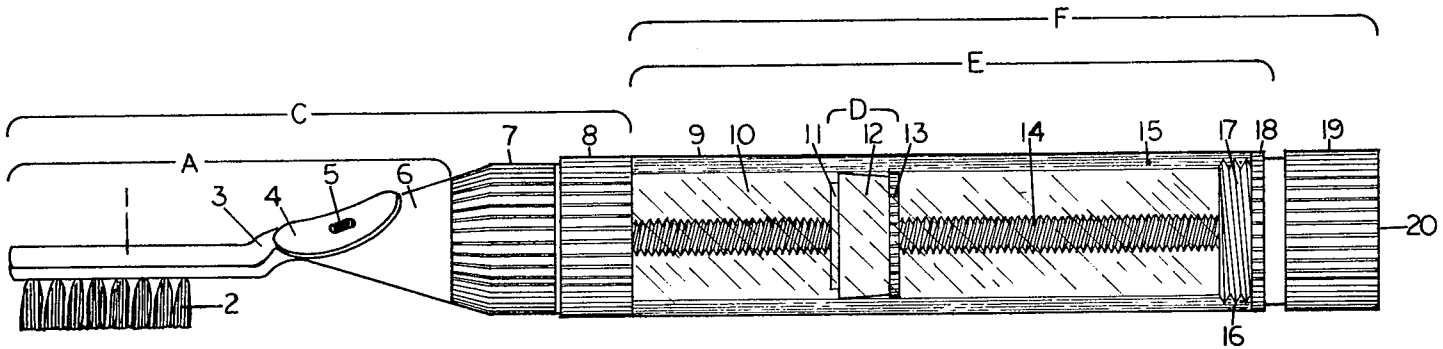
FIG. 1 is a perspective side-elevation view of the assembled preferred embodiment of the invention whereby the left or brush end of the invention is the front end of the invention.

Referring now to the drawings approximating in actual size and in detail of my prototypes wherein like numerals refer to like members, like capital alphabetical letters refer to like assemblies or major units each consisting of several members, and wherein the left end of the drawings refer to the front end and the right end of the same drawings refer to the rear end, I have illustrated in FIG. 1 a perspective view of the preferred embodiment of the invention, a versatile dental hygiene and shaving device, manufactured primarily of a suitable rigid plastic material, which is practical, is multipurpose, has commercial eye-appeal and application, and has a nice sense of balance wherein the front end depicts a removably attached tooth-brush head dispensing unit, whenever the device is used as a multi-purpose dental hygiene device, consisting of a head base 1 in which tooth-brush or denture-brush bristles 2 are imbedded securely, an offset shank 3 sloping downwardly at approximately 45°, stop cavity 69, a concave-shaped semi-circular saddle 4 which contains saddle orifice 5 more or less centered within saddle 4 and in combination wherefrom tooth paste, denture cleansing cream or liquid, denture adhesive paste or creams, or shaving cream or lather are dispensed and then removed by a person's lips, fingertips, or dispensed directly onto full or partial dentures, whichever applicable, and dispensing housing 6 conically-shaped to be removably mated by means of internal threads with the remainder of the device. Said members 1 through 6 plus said member 69 are integral members of dispensing unit A.

Figure 3:
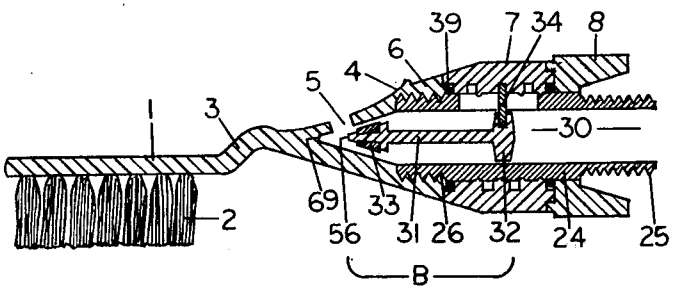
FIG. 3 is a cross-sectional view of the preferred embodiment of the assembled head assembly showing a regressed valve assembly to open the saddle orifice and also showing the preferred location of the saddle on the top surface of the dispensing housing.
Figures 8, 9, 10, 11, 12, 13:
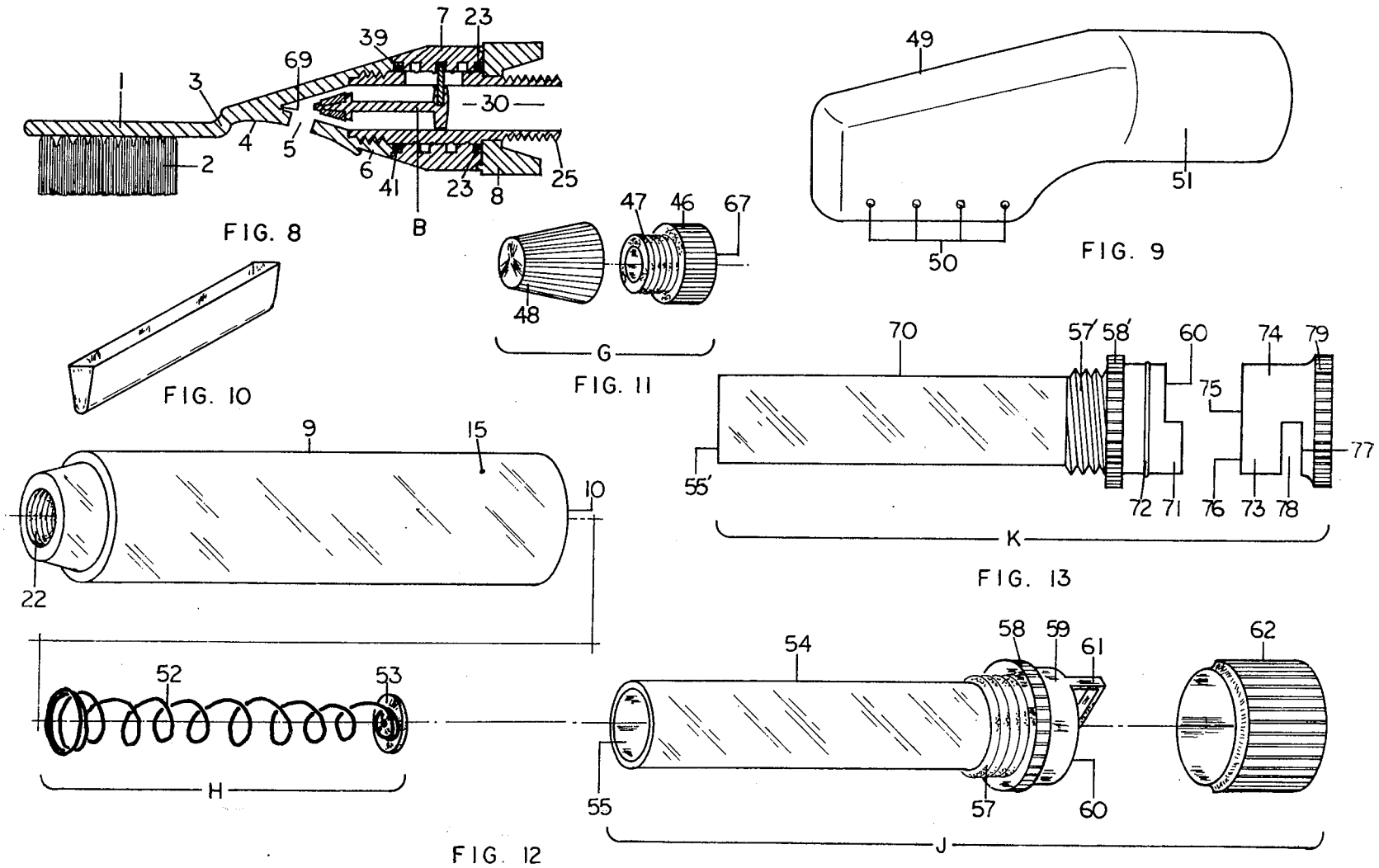
FIG. 8 is a cross-sectional view of the assembled head assembly with the saddle orifice in an opened position and with an alternate location of the saddle and the saddle orifice on the bottom surface of the dispensing housing.
FIG. 9 is a perspective view of the head protective cover.
FIG. 10 is a perspective view of the razor guard.
FIG. 11 is an exploded view of the adaptor and sealing cap assembly.
FIG. 12 is an exploded perspective view of the second embodiment of the invention of the handle assembly to hold, store, and dispense tablet material.
FIG. 13 is an exploded perspective view of an alternative assembly of tablet dispenser.

FIG. 3 and FIG. 8 are cross-sectional views of the head assembly depicting the saddle orifice 5 in an opened position whereby both views are identical except for the locations of the combined saddle 4 and saddle orifice 5. Referring to FIG. 3, the saddle 4 and saddle orifice 5 are located at the top of dispensing housing 6 while in FIG. 8 the same said members 4 and 5 are located on the bottom or opposite side of dispensing housing 6. Due to my improved system design and construction, saddle 4 and dispensing housing 6 in no way interfere with the brushing of teeth or with shaving.

Referring back now to FIG. 1, knurled regulating ferrule 7 is employed by rotation to open and close saddle orifice 5 and also to regulate the flow of materials to be discharged through said member 5. Knurled connecting ring 8 is permanently joined to a conduit located internally of said member 8 and by a combination of members, to be later described, constitutes the exterior rear end of the head assembly C. Unit A plus said members 7 and 8 comprise externally shown assembly C. Barrel 9 is a hollow casing preferrably cylindrical but not limited thereto and made of suitable disphanous material with reservoir 10 therein. Piston assembly D consists of member 11 piston compensating expander, tapered expandable sleeve 12, and piston compression adjusting disk 13 which in combination is used to push contents of reservoir 10 forwardly to the front end. Threaded spiral feed rod 14 upon which assembly D is mounted is employed by rotation of piston actuating knob 19 to advance or regress assembly D. Reservoir vent aperture 15, located near the rear end of barrel 9, is the size of a pin-hole located through the interior wall of reservoir 10 and continues through an exterior wall of barrel 9. As can be seen in the scale drawings, the vent aperture 15 is located in the reservoir wall so that it is never exposed beyond the front face sleeve 12 of the piston assembly D. Member 16 is the rear internal threads of cylindrical barrel 9 and is used to mate with member 17 external threads of reservoir housing plug 18 which in turn is used to seal the rear end aperture of barrel 9. The combination of said assembly D and said members 9, 10, 14, 15, 16, 17 and 18 comprise barrel assembly E. Handle assembly F consists of said assemblies D and E plus said member 19 as per this FIG. 1.

Figure 2:
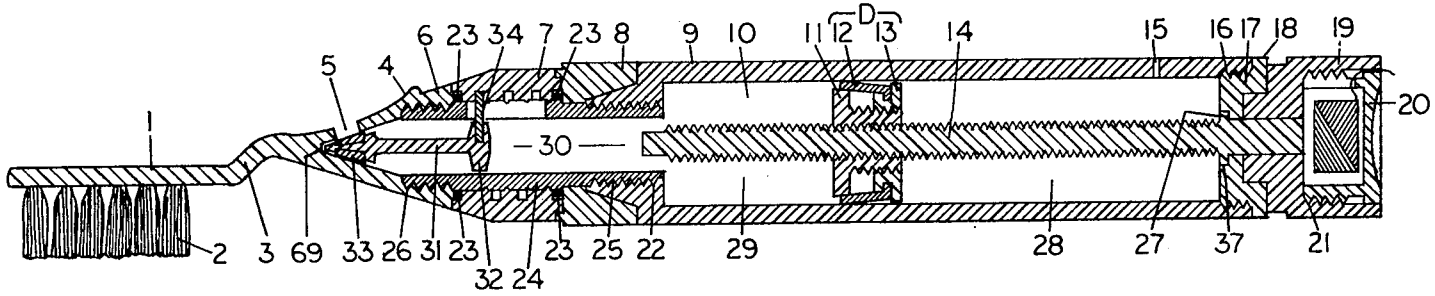
FIG. 2 is a cross-sectional view of the assembled preferred embodiment of the invention showing the maximum advancement of the valve assembly to close the saddle orifice.

Referring now to cross-sectional view FIG. 2 plus exploded view FIG. 5 in combination of the preferred embodiment to describe fully members and functions thereof. In FIGS. 2 and 5 internal stopper 20 contains external threads on a protruding rim to mate with knob internal cavity threads 21 of piston actuating knob 19 in such a manner that after mating the rear end of said member 20 is flush with the rear end of said member 19. On the external rear end base of the internal stopper 20, a slot is provided to engage a small coin to rotate manually and secure said member 20 into the open end cavity of said member 19. The interior of internal stopper 20 is a cavity wherein primarily a few denture cleansing tablets can be held and stored temporarily or in which a bobbin of dental floss may be enclosed.

Referring to FIGS. 2, 3, 6, and 8 member 22 is the front internal threads of barrel 9 engaging the corresponding member 25, rear external threads of dispensing conduit 24, to provide a secure joining of the two main assemblies: head assembly C and handle assembly F. Dispensing conduit 24 is a barrel-like cylindrical part having rear external threads 25 at the rear end and front external threads 26 at the front end, having a smoothbore aperture end to end approximately ⅜ inch interior diameter, an opening identified as passageway 30, more than ample for the passage of paste, cream, lather, or liquid contents of reservoir 10, an annulated portion on the center exterior surface to reduce friction, if any, and to provide lubrication between the rotation of internal threaded grooves 43 of knurled regulating ferrule 7 and the stationary dispensing conduit 24, and an elongated aperture 44, running longitudinally, also thereon. Knurled connecting ring 8 is bonded permanently onto the rear end of the annulated surface of dispensing conduit 24 to provide easy detaching and attaching of said assemblies C and F. Protruding rim 45 of knurled connecting ring 8 snaps-on over the protruding rim 42 of knurled regulating ferrule 7 yet still providing easy rotability of said member 7.

FIG. 6 knurled regulating ferrule 7 includes two recessed seats 41, one at each end of the cylindrical aperture 40, to accept "O" rings 23 made of rubber or soft plastic, to stop any leakage of contents at the junctures of dispensing housing 6, knurled regulating ferrule 7, and knurled connecting ring 8. Also in said member 7, internal threaded grooves 43 are somewhat deep, wide, and rounded grooves so provided to receive valve pin 34 as shown in FIGS. 2, 3, 6, 7 and 8 which in combination with elongated aperture 44 extending therefrom valve stem 31, and valve pin holder 32 and the rotation of knurled regulating ferrule 7 causing replaceable valve seat 33 to advance or regress. Valve seat 33 as shown in FIGS. 2, 3, 6, 7 and 8 is a conically shaped replaceable seat, made of rubber or soft plastic, with a tapered aperture whose larger opening is located at the larger conical base frictionally mounted on the front tapered end of valve stem 31 and is retained in position on tapered valve stem 31 by its integral members 35 retaining collar and 56 seating collar to provide a positive closure of saddle orifice 5 when needed. At the "T" end of valve stem 31, the valve pin holder 32 has a round, smoothbore cup, about one-third of the length of said member 32, to receive valve pin 34 frictionally. Valve assembly B consists of valve stem 31, valve pin holder 32, valve seat 33, and valve pin 34.

Figure 4:
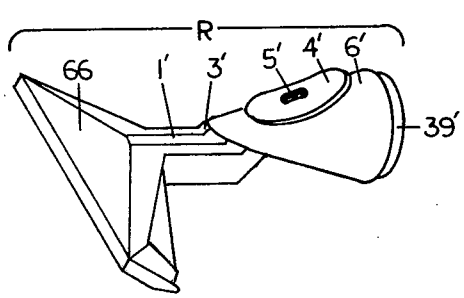
FIG. 4 is a perspective view of the razor dispensing housing as one of the attachments.

In FIGS. 1, 2, 3, 4, 6 and 8 dispensing unit A is removably attached to dispensing conduit 24 by means of the internal threads of dispensing housing 6 mated with the front external threads 26 of dispensing conduit 24. Knurled regulating ferrule 7, which is rotated manually, is held in place by means of protruding rim 39 an integral member of dispensing housing 6 inserted into the cylindrical aperture of knurled regulating ferrule 7. Dispensing housing 6 includes conically-shaped stop cavity 69 as an integral member to stop effectively any further advancement of valve seat 33. Dispensing unit A is made available as a replaceable unit in a variety of tooth or denture bristles 2 relative to size and hardness. Dispensing unit A can be easily replaced by dispensing unit R to be used as a shaving cream or lather dispensing unit with a shaving head 66 as an integral member as depicted in FIG. 4 as well as members 1', 3', 4', 5', 6', and 69' exactly equal to said unprimed numbered members, whereby with shaving cream or lather as the content in reservoir 10, the result is a portable functional dispensing shaving device. To attach and detach said unit A or R, rotate said A or R clockwise to detach, and counter-clockwise to attach. Valve seat 33 first must be regressed slightly away from saddle orifice 5 to prolong life of valve seat 33.

In FIGS. 1, 2, and 5, threaded spiral feed rod 14, most of which is threaded, runs longitudinally from the front end of reservoir 10 and permanently terminates in the base of piston actuating knob 19. The remaining unthreaded portion of said member 14 consists of an integral member thrust collar 27 to absorb an intentional thrust parallel to the rotation of threaded spiral feed rod 14 and which is fitted snugly yet rotatably in the recessed seat 37 in the center of reservoir housing plug 18, and a non-threaded rear end which continues rotatably through said member 18 by means of a smooth aperture 36 and finally terminates, permanently affixed, in seating hole 38 of piston actuating knob 19.

Piston assembly D is advanced or regressed by manual rotation of piston actuating knob 19 in cooperation with threaded spiral feed rod 14 upon which assembly D is mounted. The right angle front end wall of reservoir 10 provides a positive stop to the advancement of piston assembly D. Assembly D is designed to fit snugly always against the walls of reservoir 10 to permit maximum compression to provide positive means for advancement or regression and to prevent spinning of assembly D within reservoir 10. Unfortunately, the spinning of a one part piston, which is short-lived, would create problems, as disclosed in other devices, this same piston would not advance or regress and by loss of compression it would cause contents to be in the rear end 28 as well as in the front end 29 of reservoir 10 as depicted in FIG. 2, and this compression loss can take place in any shaped reservoir or piston if no provisions were made to enable the piston to fit snugly against the reservoir 10 wall.

To avoid these problems of other patented devices, my assembly D consists of several parts to assure maximum compression easily and quickly. In FIG. 5 in particular, as well as in FIG. 2, piston compression adjusting disk 13 is a part consisting of knurled ring 65, a recessed rim, a flange, and an internally threaded aperture as integral members thereof. Tapered expandable sleeve 12 is made of suitable pliable plastic material consisting of a round tapered sleeve with the aperture diameter in the front end being larger than that of the rear end, an inwardly protruding lip at the rear end of the sleeve, and an internal groove 64 starting at the front end of the sleeve and terminating at the protruding lip as integral members thereof. Piston compensating expander 11, as is said member 13, is made or rigid plastic material, and consisting, as integral members thereof, a tongue 63 located on the disk to mate with internal groove 64, an externally threaded rear projection to mate with the internally threaded aperture of said member 13, and an internally threaded an centered aperture in piston compensating expander 11 throughout to mate with the external threads of threaded spiral feed rod 14. To create piston assembly D, the flange of piston compression adjusting disk 13 is pressed into the rear end of tapered expandable sleeve 12 to engage the protruding lip of said member 12 with the recessed rim of said member 13 to contain flange of said member 13 therein of said member 12 fitting snugly yet rotatably thereon as a sub-assembly. The externally threaded projection of said member 11 is inserted and mated with the internally threaded aperture of said member 13 simultaneously with the mating of tongue 63 of said member 11 and internal groove 64 of said member 13. As knurled ring 65 of said member 13 is manually rotated clock-wise, piston compensating expander 11 is drawn inwardly toward tapered expandable sleeve 12 expanding the circumference of the front end of said member 12 to the desired dimension. By rotating reservoir housing plug 18 counter clockwise until it is completely disengaged from barrel 9 and then by manually pulling away said member 18 from barrel 9 just until knurled ring 65 of piston compression adjusting disk 13 appears, the adjustment can be made right there and then without any difficulty against the interior walls of the reservoir 10. The tongue and groove combination is preferred for said assembly D but does not preclude a combination of an externally ribbed piston compensating expander to mate with an internally ribbed tapered expandable sleeve.

To operate the device with said dispensing contents therein the knurled regulating ferrule 7 is rotated counter clock-wise to regress valve assembly B thereby opening saddle orifice 5. Piston actuating knob 19 is turnd clock-wise to advance piston assembly D steadily pushing contents of reservoir 10 into and through passageway 30 and exiting through saddle orifice 5. The flow of contents being dispensed by the advancement of piston assembly D can be regulated by knurled regulating ferrule 7 by slowly rotating same, one way or another, until the desired flow is achieved. Said piston actuating knob 19 need not be employed all of the time to dispense contents. Due to pressure exerted on contents already in passageway 30 by the stationary advanced position of piston assembly D, sufficient said contents are within said passageway 30 to be dispensed by rotation of knurled regulating ferrule 7 alone for at least one application of said contents. Saddle orifice 5 is positively closed and sealed by valve seat 33 when seating collar 56 with said member 33 advance and reach by rotating knurled regulating ferrule 7 clock-wise the funnel-like stop cavity 69 of dispensing housing 6, corresponding internally to the external contour of said member 33, stopping firmly any further advancement of valve seat 33.

After usage of the dental hygiene device, the dispensing Unit A end is cleaned and rinsed and then member 49 head protective cover of FIG. 9 is inserted, through an aperture at the rear end, over the corresponding contour of the front end of the device, until snap-on friction sleeve 51 mates frictionally with rear exterior end knurled regulating ferrule 7. Members 50 of FIG. 9 are perforations of said member 49 to keep dispensing unit A dry, clean, and sanitary.

After usage of the shaving device, the dispensing unit R is similarly cleaned as above and razor guard 68 of FIG. 10 is frictionally placed on shaving head 66 to protect blade(s) and to provide personal safety.

To fill the device with said contents to be dispensed through saddle orifice 5, the head assembly C is disengaged from handle assembly F by either rotating knurled connecting ring 8 clock-wise or by grapsing said member 8 and turning handle assembly F counter clock-wise. Piston assembly D is then regressed fully to reservoir housing plug 18 which stops regression effectively by rotating piston actuating knob 19 counter clock-wise while trapped air in rear end 28 of reservoir 10 escapes through reservoir vent aperture 15; regression of piston assembly D would be very difficult or impossible without said member 15 due to the trapped air in reservoir 10. External threads of a large size tube of tooth paste, denture cleansing cream, denture adhesive paste, or shaving cream or lather are mated with the front internal threads 22 of barrel 9. Said contents of the tube are discharged by squeezing tube into reservoir 10 until same is full. Reassembling the complete device is performed easily and quickly in reverse order to that mentioned above.

An adaptor 46, as depicted in FIG. 11 is used when filling reservoir 10 with said contents other than size mentioned above, such as from small tooth paste tubes or any other container in which its dispensing end does not communicate with the front internal threads 22 of barrel 9. After head assembly C is disengated from handle assembly F and piston assembly D is regressed, as mentioned above, the externally threaded nozzle 47 of adaptor 46 is mated with the front internal threads 22 of barrel 9. The internal section, adaptor cavity 67 of adaptor 46 on the opposite side of said member 47 consists of female internal threads, half-moon shapes (for pressurized shaving agents), or other means to communicate with the dispensing end of the external container. The transmission of paste, cream, or liquid agents from said external containers into reservoir 10 takes place via said member 67, 47, and 46. A sealing cap 48 with internal threads is provided to mate with and to seal the externally threaded nozzle 47 of adaptor 46 in case contents of said containers have not been expended thereby enabling easier refilling of reservoir 10 the next time merely by removing sealing cap 48 and inserting said member 47 into said member 22. The assembly of adaptor 46 and sealing cap 48 is designated as assembly G.

To clean the invention for the purpose of switching reservoir 10 said contents from one to another, such as from tooth paste to shaving cream for example is accomplished easily. Remove handle assembly F from head assembly C by grasping knurled connecting ring 8 and turning barrel 9 counter clockwise. Remove simultaneously piston assembly D, threshold spiral feed rod 14, reservoir housing plug 18, and piston actuating knob 19 from barrel 9 by rotating the knurled disk portion of reservoir housing plug 18 counter clockwise and pulling out said member. With warm soapy water, clean front end of reservoir housing plug 18, clean piston assembly D and threaded spiral feed rod 14 by grasping firmly assembly D and rotating piston actuating knob 19 back and forth, clean reservoir 10, and clean head assembly C by rotating knurled regulating ferrule 7 back and forth to open and close saddle orifice 5 allowing warm soapy water to enter passageway 30. Rinse cleaned parts in cool water, allow to thoroughly dry, reassemble handle assembly F in reverse order of above, fill reservoir 10 with new contents, and then reassemble handle assembly F to head assembly C in reverse order to above. As an effective and functional shaving device then, housing unit A is substituted by housing unit R along with razor guard 68. Replacing said unit A by said unit R of FIG. 4 is easily accomplished as mentioned previously.

DESCRIPTION OF THE SECOND EMBODIMENT

Dental hygiene practitioners having full or partial dentures can use this second embodiment of the invention to advantage whereby the diaphanous barrel 9 is used having means to hold, store, display visually and dispense denture cleansing tablets functionally and effectively in place of contents mentioned in the first embodiment. Said tablets are dispensed into a denture bath to remove film and stain from dentures. The precleaning and brushing of dentures, if necessary to remove food particles therefrom prior to the denture bath is performed by usage of FIG. 1 members, head base 1 and bristles 2, at the front end of the invention.

The conversion of the first embodiment of the invention to the second one is accomplished easily by just providing an empty reservoir 10 firstly in the device with head assembly C still attached.

Referring to FIG. 5, prior to filling the second embodiment of the device with denture cleansing tablets, piston assembly D, threaded spiral feed rod 14, reservoir housing plug 18, and piston actuating knob 19 are easily removed simultaneously by pulling from barrel 9 after the necessary rotations of the knurled portion of reservoir housing plug 18 in a counter-clockwise direction.

Now referring to FIG. 12, conical pusher spring 52, made of suitable metallic material, has pusher plate 53 permanently attached to the small spiral end of said member 52 and combined as assembly H is used to prevent breakage of and to advance constantly denture cleansing tablets contained within the second embodiment of the invention. The large spiral end of said assembly H is inserted into the rear end aperture of the now empty barrel 9 and shoved to the extreme front end of reservoir 10 wherein said end of said assembly is frictionally positioned and whereby pusher plate 53 is extended beyond the rear end aperture of barrel 9. Assembly letter "I" and "O" were left out purposely to avoid confusion with similar appearing numbered members.

A primary purpose of tablet dispensing tube 54 is to provide practical and effective means to stack, align, and contain denture cleansing tablets for easy insertion into empty reservoir 10; without such said member 54, the filling of reservoir 10 with said tablets would be a difficult maneuver. A secondary purpose, but by no means unimportant is to provide means to check visually contents supply easily and quickly and to dispense said tablets effortlessly and effectively.

Tablet dispensing tube 54, made of a suitable, rigid, diaphanous plastic material, hollow and shaped cylindrically has an exterior circumference that fits snugly yet rotatably within said reservoir 10. The length of said member 54 is approximately 95% of the length of reservoir 10 to permit space for the regression of said assembly H within said member said member 10. Tablet dispensing tube 54 has, integral members thereof, a hollow cylindrical dispensing reservoir 55 whose diameter is slightly larger than that of denture cleansing tablets to be contained therein, external threads 57 providing means for engaging and securing said member 54 into reservoir 10 by mating with rear internal thread 16, knurled dispenser ring 58 to rotate external threads 57, protruding rim 59 whose external circumference is such to accept frictionally internal aperture wall of friction end cap 62, discharge aperture 60, and tablet dispensing retainer 61, a "block U" shaped bar, whose interior dimensions are slightly larger than the thickness and diameter of one said tablet, projecting from the rear end of protruding rim 59 to retain and stop the advancement of said tablets by said assembly H yet enabling one denture cleansing tablet to appear and to be dispensed through discharge aperture 60 only one at a time. Friction end cap 62 is snapped frictionally onto protruding rim 59 to enclose tablet dispensing retainer 61 and to provide a sanitary sealing of discharge aperture 60.

To dispense denture cleansing tablets within said member 54, friction end cap 62 is removed frictionally from protruding rim 59 and the desired number of said tablets are discharged from said member 61 one by one by the flick of a user's finger. Friction end cap 62 is then re-engaged frictionally to said member 59.

The assembly of tablet dispensing tube 54 and friction end cap 62 comprises tablet dispensing assembly J. The assembly of barrel 9, assembly H and assembly J comprises tablet handle assembly L.

With said assembly J in an upright position, whereby said member 62 is at the bottom, on any flat surface, filling the second embodiment of the invention with denture cleansing tablets is easily done. Said tablets are inserted into the opened upright end of the dispensing reservoir 55 and allowed to slide down to tablet dispensing retainer 61 until said member 55 is filled to capacity except lacking one said tablet to provide sufficient empty space within said member 55 to accept the inclusion of spring pusher plate 53 whose diameter is slightly smaller than that of said member 55. With empty reservoir 10 of the device in a vertical position aligned with dispensing reservoir 55, engage spring pusher plate 53 extending from reservoir 10 with said empty space in said member 55, shove said assembly J with the other hand into reservoir 10 regressing said member 53, mate external threads 57 with internal threads 16 of barrel 9 and secure one to the other by rotating knurled dispenser ring 58 clock-wise to complete an effective and functional assembly of the second embodiment of the invention.

Referring now to FIG. 13, an alternate, system design and construction, per another prototype of mine, of component parts to replace tablet dispensing tube 54 and friction end cap 62 if desired. Although the component parts in FIG. 13, referred to as alternate tablet dispensing assembly K, are similar to those of said assembly J, there is a slight difference in appearance and performance in the dispensing of denture cleansing tablets with no end cap being removed. Integral numbers of alternate dispensing tube 70 are dispensing reservoir 55', external threads 57', knurled dispenser ring 58', discharge aperture 60', projected rim 71 and friction tongue 72. Approximately one-half of projected rim 71 extends further, by the thickness of one said tablet, than the other half. Slotted end cap 73, has an integral members end cap rim 74, internal groove 75 located in the interior wall of said member 74 to frictionally engage and mate with friction tongue 72, rim aperture 76 is the internal area of said member 74, rim base 77 is the solid base sealing rear end of rim aperture 76 providing a positive discharge stop, slot 78 is an elongated aperture, slightly wider than the thickness of a denture cleansing tablet, adjacent to rim base 77, and less than half encircling the circumference in the same direction of end cap rim 74; and finally turning ring 79. The constant said assembly H pressure of said tablets against rim base 77 provides assistance to the dispensing of said tablets one by one.

The external circumference of said member 71 is approximately equal to the internal circumference of said member 74 to provide an effective friction assembly.

Slotted end cap 73 is frictionally snapped-on to alternate dispensing tube 70 thereby engaging and mating snugly friction tongue 72 and internal groove 75 yet providing rotatability of said member 73. The resulting said assembly K causes the extended portion of projecting rim to barely touch rim base 77 yet providing smooth rotatability of slotted end cap 73.

The holding, storing, checking supply visually, filling denture cleansing tablets and the inserting into and engaging of said assembly K with barrel 9 is the same as aforementioned for said assembly J. Dispensing said tablets one at a time is simply done by rotating turning ring 79 in any direction until said tablet is dispensed through slot 78. Alternate tablet handle assembly M comprises barrel 9 plus said assemblies H and K.

Referring back not to FIGS. 12 and 13, the description and construction of said tablet dispensing tube and said alternate dispensing tube does not preclude having similar members instead made of any suitable material and having an elongated, longitudinal slot thereof to display contents therein.

DESCRIPTION OF THE THIRD EMBODIMENT

The purpose of the third embodiment of the invention is to provide dental hygiene practitioners with means of holding, storing, visually checking supply, and dispensing tooth powder in desired amounts to brush natural teeth or dentures and to provide dental hygiene practitioners with partial or full dentures means to hold, store, visually check supply, and dispense denture adhesive powder in any desired amounts. This third embodiment provides a practical, functional, portable dispensing dental hygiene device for those practitioners preferring usage of powdery agents by means of an easy conversion of the handle assembly of the preferred embodiment of the invention.

Figure 14:
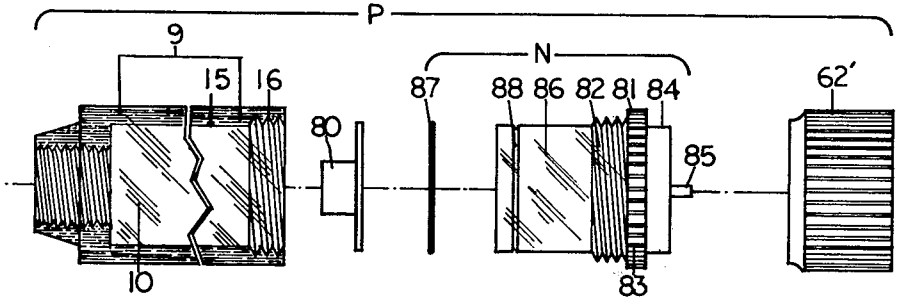
FIG. 14 is an exploded perspective view of the third embodiment of the invention showing means for holding, storing, and dispensing powdery material.
Figure 15:
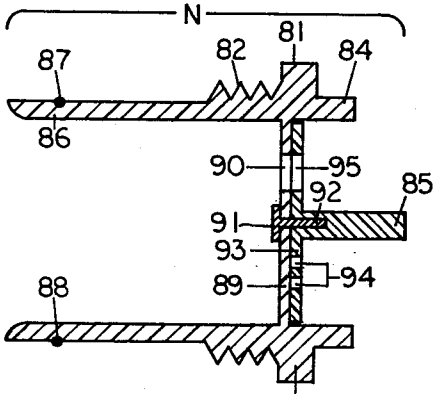
FIG. 15 is an enlarged cross-sectional view of the powder dispensing plug.

The removal of component parts from barrel 9, which is still attached to head assembly C as mentioned in the second paragraph of the DESCRIPTION OF THE SECOND EMBODIMENT, is performed in the same manner prior to any usage of powdery agents. Referring now to FIG. 14, an exploded perspective view of the powder dispensing handle assembly P of the third embodiment of the invention, conduit closure plug 80, made of semi-rigid plastic material, consisting of a circular collar to stop further advancement into the front end portion of empty barrel 9, a circular cavity centered in the rear portion of said member 80 to accept the non-writing end of a pencil, and a circular frontal projection as integral members thereof. Said member 80 is dropped into vertically positioned empty barrel 9 through its rear end aperture into reservoir 10 with the frontal projection portion of said member 80 headed toward the front end of reservoir 10. The non-writing end of an ordinary pencil or any other similar object is used, by engagement with said cavity, to push frontal projection of said member 80 frictionally into passageway 30 of FIG. 2 thereby sealing off the front end aperture of reservoir 10; the pencil or similar object is then withdrawn. A rubber or soft plastic "O" ring 87 is used to prevent any powdery materials from escaping through reservoir vent aperture 15 of FIG. 2 and also from reservoir 10 of FIG. 2 with said contents contained therein. In FIGS. 14 and 15 dispensing plug 81, primarily cylindrical is made of a suitable, rigid, diaphanous plastic material to provide means to check content supply visually therein, has as integral members thereof external plug threads 82, rotator 83, protruded rim 84, plug wall 86, "O" ring groove 88 to removably secure "O" ring 87 in one position on the near front end exterior of plug wall 86 and yet to provide expansion and compression of said member 87, and plug base 89. Friction end cap 62' has a rim whose internal circumference is such to attach frictionally to the external circumference of said member 84 to provide a sanitary and dry seal thereof.

FIG. 15 is an enlarged cross-sectional view of dispensing plug 81 to illustrate not only the said member itself but also to show other members assembled therein to comprise powder dispensing plug assembly N. Plug wall 86 projects sufficiently forward with "O" ring 87 thereon to go beyond reservoir vent aperture 15 of FIG. 2 whenever dispensing plug assembly N and barrel 9 are assembled; plug wall 86 has an internal tapered portion at its extreme front end to deflect powdery materials properly through said member 81 during the dispensing of said materials; the external diameter of plug wall 86 is slightly less than the diameter of reservoir 10. Friction connecting plug 91 is inserted through plug base 89 by means of an integral member a small centered aperture thereof to mate frictionally with handle cavity 92 to secure rotating disk 93, fitted snugly yet rotatably, to the opposite side of plug base 89.

Figure 16:
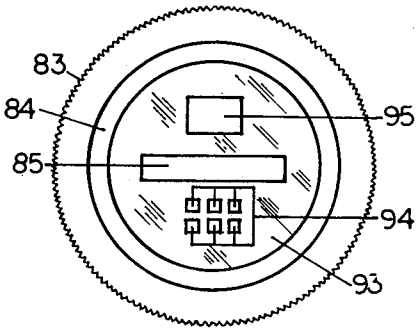
FIG. 16 is a perspective end view of the powder dispensing plug assembly.

Continuing on with FIG. 15 plug base 89 having a plug base aperture 90 as an integral member thereof whereby said member 90 is an off-set aperture of sufficient size to provide continuous flow for dispensing powdery materials through dispensing plug 81 from reservoir 10. In FIG. 15 plus FIG. 16, perspective end view of dispensing plug assembly N, are illustrated a thin rotating disk 93 made of suitable, diaphanous plastic material having a rigid turning handle 85 centered thereon and protruding therefrom at a 90 degree angle to rotate said member 93, having a large disk aperture 95 off-set aperture of relatively the same size and shape as a plug base aperture 90, and having a small disk aperture 94 collectively off-set apertures whose total open area is approximately 30% of that of said member 95, all as integral members thereof. All of said members as described and illustrated in FIGS. 15 and 16 comprise powder dispensing plug assembly N.

Powder dispensing handle assembly P for filling of the third embodiment of the invention with powdery material consists of the assembling of empty barrel 9 with conduit closure plug 80 inserted therein, powder dispensing plug assembly N, and friction end cap 62' which said assembly P is still attached to head assembly C.

After conduit closure plug 80 is inserted into empty barrel 9, powdery materials are dispensed from an external container into rear end aperture of vertically-positioned barrel 9 to fill reservoir 10 to a desired level below reservoir vent aperture 15; external plug threads 82 of said assembly N are mated with rear internal threads of barrel 9 and secured thereto by rotation of rotator 83 clock-wise and also by rotation of turning handle 85 in any direction to assure a positive closure of plug base aperture 90 to check visually through the diaphanous rotating disk 93 and that said members 94 and 95 are not aligned with said member 90. Friction end cap 62' is snapped onto protruded rim 84 to provide an effective and functional device, as said assemblies C and P, ready for use.

To dispense powdery materials contained within device, remove friction end cap 62', rotate turning handle 85 to align said members 95 or 94 whichever is desired with plug base aperture 90, dispense said materials in desired amounts onto palm of hand for brushing teeth or directly onto dentures whichever is applicable by shaking the device. Rotate said member 85 to close plug base aperture 90 as previously mentioned and then replace friction end cap 62' onto said member 84.

To remove conduit closure plug 80 from barrel 9 whenever contents other than powdery materials are desired to be contained in reservoir 10, remove powder dispensing handle assembly P from head assembly C by grasping said assembly C and rotating said assembly P counter clock-wise and then pulling the two said assemblies C and P apart dislodging conduit closure plug 80 from passageway 30 of dispensing conduit 24 of FIG. 2. The removal of the remaining said members of said assembly P is in reverse order to that described previously for filling reservoir 10 with powdery materials.

DESCRIPTION OF THE FOURTH EMBODIMENT

The purpose of the fourth embodiment of the invention is to provide denture hygiene and shaving practitioners means to hold, store, visually check supply, and dispense tooth paste, shaving cream, denture adhesive cream or paste, or denture cleansing paste and denture cleansing tablets in one portable device that is effective, functional, practical, convenient and long-lasting having commercial "eye-appeal".

Figure 17:
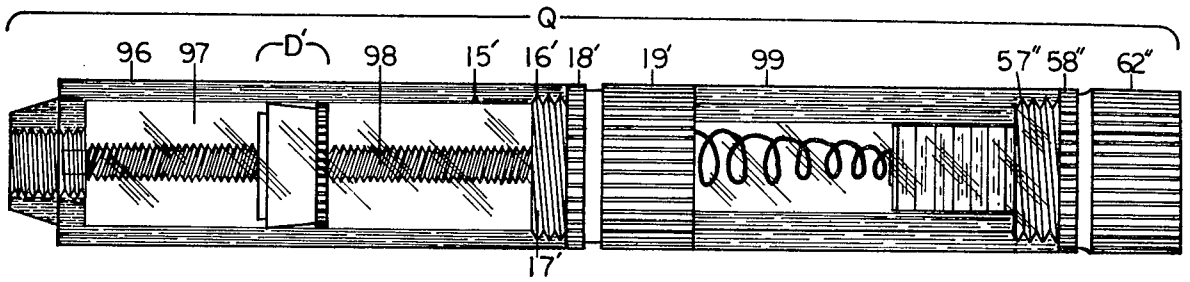
FIG. 17 is a perspective view of the fourth embodiment of the invention utilizing a combination handle for two different materials.

The fourth embodiment employs two short casings in tandem comprising one handle whereby the front casing is for creamy, pasty, or liquid materials as the contents therein and the rear casing is for denture cleansing tablets as the contents therein as depicted in FIG. 17, a perspective view of the fourth embodiment of the invention, slightly enlarged to show detail.

Referring to FIG. 17 illustrating the handle portion only without illustrating again the head assembly C removably attached thereto as depicted in FIGS. 1, 2, 3, 4 and 6, short front casing 96 a preferably cylindrical but not limited thereto hollow short casing made of a suitable diaphanous material to provide means for easy and quick checking of contents visually, replaces barrel 9, short front reservoir 97 replaces reservoir 10, short threaded feed rod 98 is exactly the same as threaded spiral feed rod 14 of FIGS. 1, 2, and 5 except for a shorter threaded portion thereof, front internal threader 22', reservoir vent aperture 15', piston assembly D', rear internal threads 16', external threads 17', reservoir housing plug 18', piston actuating knob 19' and knob internal cavity threads 21' are counterparts respectively of said unprimed numbered members of FIGS. 1, 2, and 5. No counterpart of internal stopper 20 is needed in this fourth embodiment of the invention. The said members listed above plus those not listed to avoid repetition comprise short front casing assembly Q and the unlisted members and the operation, holding, storing, checking supply visually, filling, and discharging said contents therein are similar to that described previously in the Description of the Preferred Embodiment.

Figure 18:
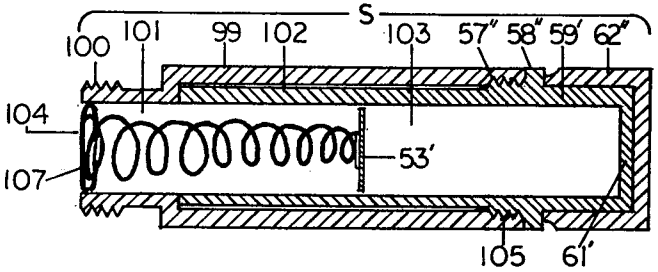
FIG. 18 is a cross-sectional view of the tablet end of the handle of FIG. 7.

FIG. 17 also illustrates a perspective view of short rear tablet casing assembly S, described below, attached to said assembly Q. Referring to FIG. 18, illustrated in a cross-sectional view of said assembly S, short rear casing 99 is a preferably cylindrical but not limited thereto hollow short unvented casing made of a suitable diaphanous material and of the same external diameter as barrel 9 and short front casing 96, external threads 100, short rear reservoir 101, and rear internal threads 105 as integral members thereof said member 99, plus short tablet tube 102 having the same external diameter as tablet dispensing tube 54 of FIG. 12 and made of a suitable rigid diaphanous material to visually check supply of said tablets and to keep said tablets aligned in short tube reservoir 103 therein for easy insertion into said member 101, front end casing aperture 104, and rear internal threads 105. Conical sprint 107 and pusher plate 53', external threads 57'', knurled dispenser ring 58'', protruding rim 59'', tablet dispensing retainer 61', and friction end cap 62'' are counterparts respectively of said unprimed numbered members of FIG. 12. It is to be understood that the alternate method of dispensing said tablets by said assembly K as illustrated in FIG. 13 can be employed as an alternate dispensing method of this fourth embodiment of the invention. Said tablet dispensing tube does not preclude its being made of any suitable material and having an elongated, longitudinal slot thereof to display contents. The unlisted members and the operation, holding, storing, checking tablet supply visually, filling, and dispensing denture cleansing tablets therein are similar to that described previously in the Description of the Second Embodiment.

Short rear tablet casing assembly S consists of all said members listed plus those not listed to avoid repetition and mentioned in the above paragraph. Said assembly S is joined with said assembly Q of FIG. 17 by means of engaging and mating external threads 100 with knob internal cavity threads 21' of piston actuating knob 19' by rotating short rear casing 99 clock-wise. By substituting dispensing unit R for dispensing unit A of head assembly C and having shaving cream or lather in short front reservoir 97, a practical and functional shaving device is available plus having means for the dispensing of denture cleansing tablets therein.

DESCRIPTION OF THE FIFTH EMBODIMENT

The purpose of the fifth embodiment of the invention is to provide denture hygiene and shaving practitioners in one portable convenient practical, effective, and functional device means to hold, store, visually check supply, and dispense tooth paste, shaving cream, denture adhesive paste or cream, or denture cleansing paste and tooth powder or denture adhesive powder.

Figure 19:
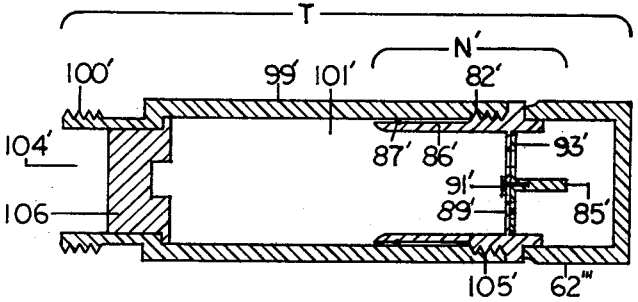
FIG. 19 is a cross-sectional view of the powder end of the handle of FIG. 17, as part of the fifth embodiment of the invention.

The fifth embodiment of the invention consists of head assembly C with dispensing unit A or dispensing unit R, whichever is applicable, removably attached thereto and two short casings in tandem whereby the front casing contains therein creamy, pasty, or liquid materials as depicted in only the short front casing portion on the left of FIG. 17 and the short rear casing contains powdery materials therein as illustrated in the cross-sectional view FIG. 19. The two short rear casing of FIG. 18 and FIG. 19 are interchangeable in combination with front casing portion of FIG. 17.

The description of the operation, holding, storing, checking supply visually, filling, and discharging front casing contents of short front casing assembly Q is similar to that described in the preferred embodiment of the invention.

Referring now to FIG. 19, short rear casing 99', a preferably cylindrical but not limited thereto, short, hollow casing made of a suitable diaphanous material, external threads 100', short rear reservoir 101', front end casing aperture 104', rear internal threads 105' and friction end cap 62'' are exact counterparts of said members depicted in FIG. 18. Counterparts of said members 102 and 103 are not needed in this fifth embodiment of the invention. External plug threads 82', rotator 83', protruded rim 84' and turning handle 85' are exact counterparts of said members depicted in FIGS. 14, 15, and 16. The powder dispensing plug assembly N of FIG. 14 is also used as is in this Fifth Embodiment. Casing closure plug 106, made of semirigid plastic material, consisting of a circular collar to stop further advancement into front end casing aperture 104', a circular cavity centered in the rear portion of said member 106 to accept the non-writing end of a pencil or any other similar object, and a circular frontal projection to fit frictionally into said number 104' to prevent any leakage of powdery materials through said member 104'. The insertion of said member 106 to seal said member 104' is done in the same manner as that described previously for conduit closure plug 80 of the third embodiment. The removal of said member 106 is also done similarly except that it is dislodged from the front end casing aperture 104'. The listed members above plus the remaining unlisted members being counterparts of those of the Third Embodiment of the invention comprise short rear powder casing assembly T. Said assembly T is joined with said assembly Q of FIG. 17 by means of engaging and mating external threads 100' with knob internal cavity threads 21' of piston actuating knob 19' by rotating short rear casing 99' clockwise. The operation, holding, storing, checking powder supply visually, filling, and dispensing powdery materials therein of said assembly T are similar to that described in the Third Embodiment of the invention.

It is understood that the invention disclosed and described concisely herein also includes variants which, as such, can be referred to one and the same device without departing from the scope of the invention and of the appended claims.

I claim:

1. A portable dispensing device comprising
a head assembly having an orifice therein;
a handle assembly removably attached to said head assembly, said handle assembly comprising
a hollow substantially rigid reservoir housing;
a piston assembly axially mounted within said reservoir housing;
a plug means at the end of said housing opposite said head assembly for sealing said housing;
an aperture through said housing positioned so that it is always behind the forward face of said piston;
a tapered expandable sleeve;
a compensating expander within said sleeve;
mating means within said sleeve and on the exterior of said expander for preventing rotational movement between said sleeve and said expander;
a piston compressing adjusting disk for axially moving said expander within said sleeve;
internal threading within said expander;
an externally threaded feed rod extending substantially the length of said housing and mating with said internal threading of said expander; and
an actuating knob secured to said feed rod externally of said housing.

2. The dispensing device of claim 1 further comprising
a thrust collar integral with said feed rod substantially at one end thereof.

3. The dispensing device of claim 1 wherein said actuating knob comprises
a hollow externally knurled member open at the end opposite said feed rod having internal threading;
a hollow externally threaded member for mating with the internal threading of knurled member; and
an external slot on the closed end of said externally threaded member.

4. The dispensing device of claim 1 further comprising
stop means within said housing located at said end adjacent said head assembly for limiting the movement of said piston assembly.

5. The dispensing device of claim 1 wherein said head assembly comprises
a hollow base;
bristles on one side of said base;
an orifice on the opposite side of said base; and
a channel within said base for communicating with said reservoir housing.

6. The dispensing device of claim 5 further comprising
a valve assembly within said base for opening and closing said orifice; and
rotatable means mounted on said base for actuating said valve assembly.

7. The dispensing device of claim 5 further comprising a frictionally engageable cover for said head assembly.

8. The dispensing device of claim 5 further comprising stop means for limiting the travel of said valve assembly.

* * * * *